US007325697B2

(12) United States Patent
Lim et al.

(10) Patent No.: US 7,325,697 B2
(45) Date of Patent: Feb. 5, 2008

(54) STORAGE BIN FOR USE WITH SHELVING SYSTEM

(75) Inventors: Gary M. Lim, Palos Verdes Peninsula, CA (US); James Sokol, Brea, CA (US)

(73) Assignee: Seville Classics, Inc., Torrance, CA (US)

( * ) Notice: Subject to any disclaimer, the term of this patent is extended or adjusted under 35 U.S.C. 154(b) by 473 days.

(21) Appl. No.: 11/049,761

(22) Filed: Feb. 2, 2005

(65) Prior Publication Data

US 2006/0169658 A1 Aug. 3, 2006

(51) Int. Cl.
*A47F 3/14* (2006.01)

(52) U.S. Cl. ..... 211/133.1; 211/59.2; 211/150; 211/133.5; 211/187

(58) Field of Classification Search ..... 211/133.1, 211/59.2, 90.03, 90.02, 106, 133.5, 184, 126.2, 211/134, 126.9, 150, 126.11, 187, 126.12, 211/126.15, 133.2, 181.1; 312/291, 301, 312/111, 107; 206/557, 561, 564
See application file for complete search history.

(56) References Cited

U.S. PATENT DOCUMENTS 4,614,273 A 9/1986 Ishii
5,415,302 A 5/1995 Carlson et al.
5,531,167 A 7/1996 Stevens et al.
5,785,189 A * 7/1998 Gollob et al. ..... 211/187
6,015,052 A 1/2000 Goldberg et al.
6,017,009 A 1/2000 Swartz et al.
6,068,143 A 5/2000 Wang
6,113,042 A 9/2000 Welsch et al.
6,116,436 A 9/2000 Ferrucci et al.
6,158,600 A 12/2000 Ferrucci et al.
6,460,710 B1 * 10/2002 Dardashti ..... 211/184
2006/0032827 A1 * 2/2006 Phoy ..... 211/59.2

* cited by examiner

*Primary Examiner*—Jennifer E. Novosad
(74) *Attorney, Agent, or Firm*—Raymond Sun

(57) ABSTRACT

A shelving system has a plurality of shelves, with each shelf having a plurality of intersecting wire rods. The shelving system also has a plurality of posts connected to the shelves and separating the shelves. A storage bin is adapted for use with the shelving system. The storage bin has a bottom wall, at least one side wall, an interior space enclosed by the at least one side wall and the bottom wall, and a plurality of rails provided on the bottom surface of the bottom wall. Each rail has a groove, with the groove of each of the rails aligned to form a row of grooves. The storage bin is seated on one of the shelves, with one of the wire rods in the one of the shelves positioned in the row of grooves to maintain the storage bin at a desired position on the shelf.

8 Claims, 11 Drawing Sheets

20
24
28
70
84
86
70
84
82
82

STORAGE BIN FOR USE WITH SHELVING SYSTEM

BACKGROUND OF THE INVENTION

1. Field of the Invention

The present invention relates to modular knock-down shelving systems, and in particular, to a system of storage bins that are adapted for use with modular shelving systems.

2. Description of the Prior Art

Modular knock-down shelving systems have become very popular in both retail and residential use. An example of a conventional modular knock-down shelving system is illustrated in U.S. Pat. No. 5,415,302 (Carlson et al.). These shelving systems are typically comprised of generally four-sided shelves made up of intersecting wire rods, with each shelf separated and supported by a post at each corner above and below the respective shelf. The user assembles the shelving system by engaging a set of four posts to each of the four corners of a shelf, placing a second shelf on top of the posts, engaging another set of posts to the second shelf, and so on until the shelving system has the desired number of shelves. The shelving system can be disassembled (i.e., "knocked down") merely by disengaging the posts from the shelves, and the posts and shelves can then be stored in a compact manner (e.g., in a box) for storage or transportation.

These conventional shelving systems have become popular because they are easy to assemble and disassemble. The user can also vary the number of shelves to fit the decor of the room or the storage requirement.

Objects and articles can be placed directly on the shelves. Alternatively, storage bins can be used to hold articles and objects, with the storage bins placed on the shelves in an organized manner. Unfortunately, the use of conventional storage bins has certain disadvantages. For example, the conventional storage bins are not secured to the shelves, so that a storage bin might slide about the shelf on which it is supported, especially if it is advertently pushed or tipped by a user or another object. This pushed or tipped storage bin may fall off a shelf, causing damage to the contents and possible injury to a person.

SUMMARY OF THE DISCLOSURE

It is an object of the present invention to provide a shelving system that safely holds a plurality of storage bins on its shelves.

It is another object of the present invention to provide a storage bin that can be engaged to the shelves of a shelving system in a manner which allows for safe and convenient access to the contents stored in the storage bin.

In order to accomplish the objects of the present invention, the present invention provides a shelving system having a plurality of shelves, with each shelf having a plurality of intersecting wire rods. The shelving system also has a plurality of posts connected to the shelves and separating the shelves. A storage bin is adapted for use with the shelving system. The storage bin has a bottom wall, at least one side wall, an interior space enclosed by the at least one side wall and the bottom wall, and a plurality of rails provided on the bottom surface of the bottom wall. Each rail has a groove, with the groove of each of the rails aligned to form a row of grooves. The storage bin is seated on one of the shelves, with one of the wire rods in the one of the shelves positioned in the row of grooves to maintain the storage bin at a desired position on the shelf.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a storage bin 20 that is adapted to be used with a shelving system 22. The storage bin 20 has a guide system provided solely along its bottom wall to retain the storage bin 20 at a fixed location on the surface of a wired shelf 24 of the shelving system 22.

Figure 1:
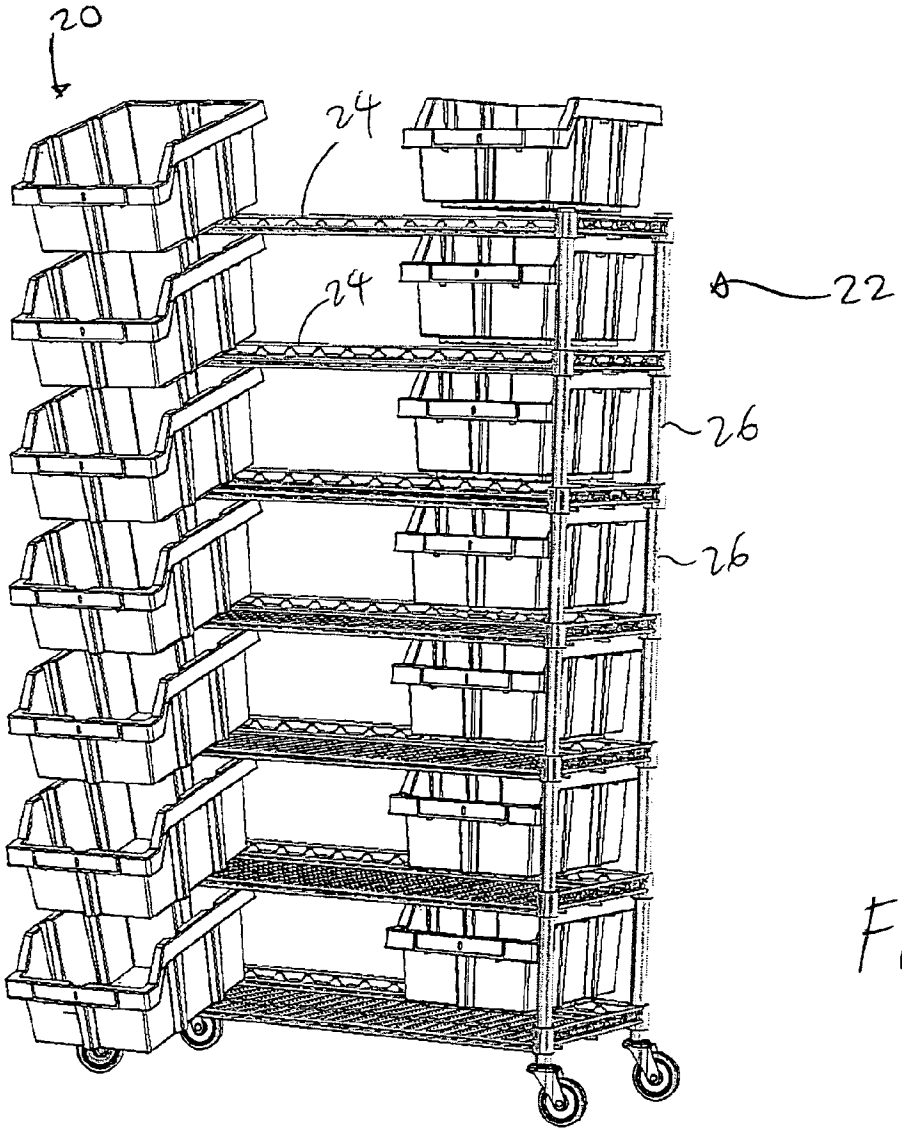
FIG. 1 is a front perspective view of a shelving system shown in use with a plurality of storage bins according to one embodiment of the present invention.
Figure 2:
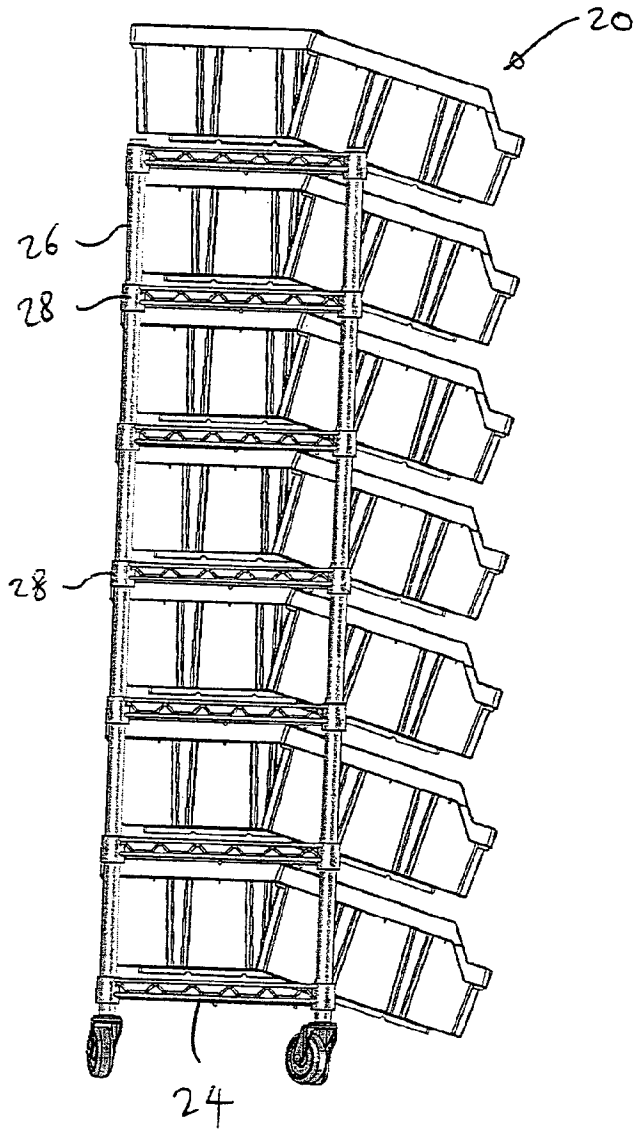
FIG. 2 is a side plan view of the shelving system of FIG. 1.

FIGS. 1 and 2 illustrate a modular "knock-down" shelving system 22 that is made up of a plurality of shelves 24 that are supported by a plurality of posts 26. Each shelf 24 can be made up of intersecting (and perpendicular) wire rods 82 and 84 (see FIG. 10), and has a generally four-sided configuration (e.g., rectangular) that defines four corners. Each post 26 has opposing ends that are removably secured to a separate aligned corner of one or two adjacent shelves 24 via collars 28. The shelving system 22, and the connection of the shelves 24 and posts 26 by the collars 28, can be implemented using the principles shown and described in U.S. Pat. No. 5,415,302 (Carlson et al.), whose disclosure is incorporated by this reference as though set forth fully herein.

A plurality of storage bins 20 are seated on the shelves 24 of the shelving system 22. Each shelf 24 can be sized and configured to hold two, three or any number of bins 20. Referring also to FIGS. 3-8, each bin 20 is adapted to hold objects and articles, and has a generally four-sided configuration (e.g., square or rectangular) with a front wall 30 and a rear wall 32 connected by parallel side walls 34 and 36. A bottom wall 38 is connected to the bottom edges of the front wall 30, the rear wall 32 and the side walls 34, 36. The front wall 30 can have a lower height than the other walls 32, 34, 36. In one embodiment of the present invention, all the walls 30, 32, 34, 36, 38 can be formed (e.g., by extruding or injecting) in a single piece. A border flange 40 can be provided along the top edges of the walls 30, 32, 34 and 36.

Figure 3:
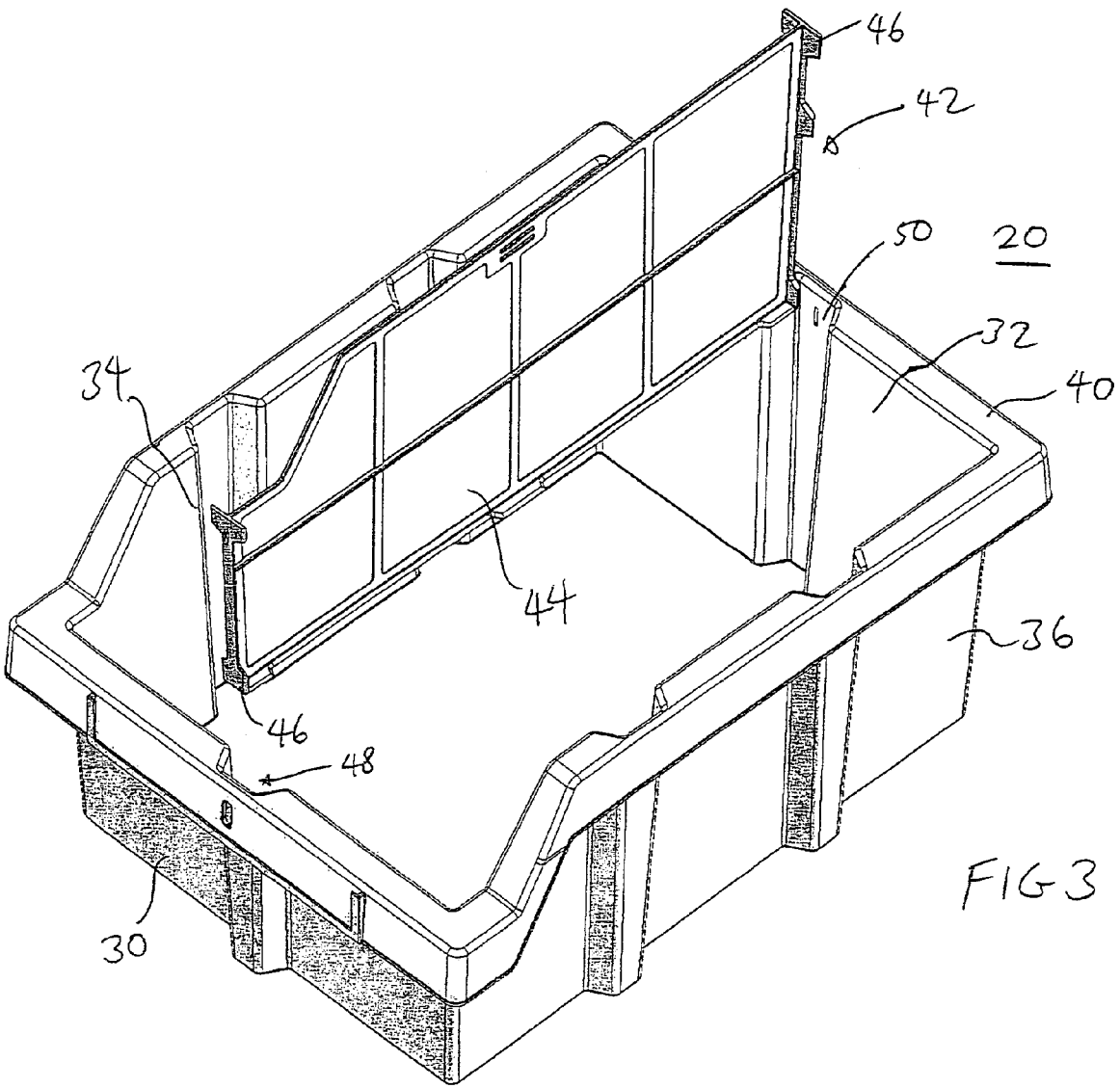
FIG. 3 is an exploded perspective view of a storage bin according to one embodiment of the present invention.
Figure 4:
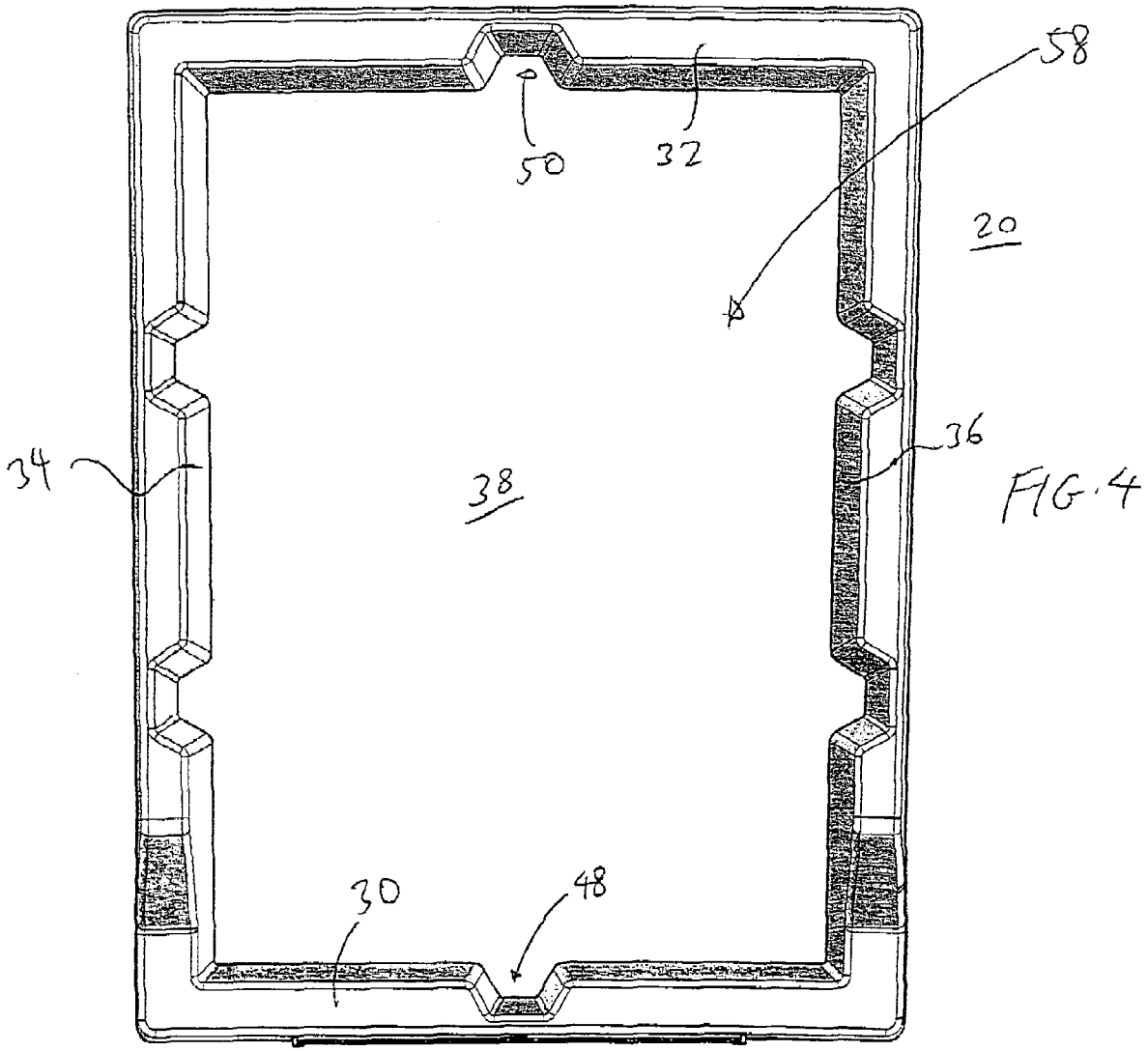
FIG. 4 is a top plan view of the storage bin of FIG. 3.
Figure 5:
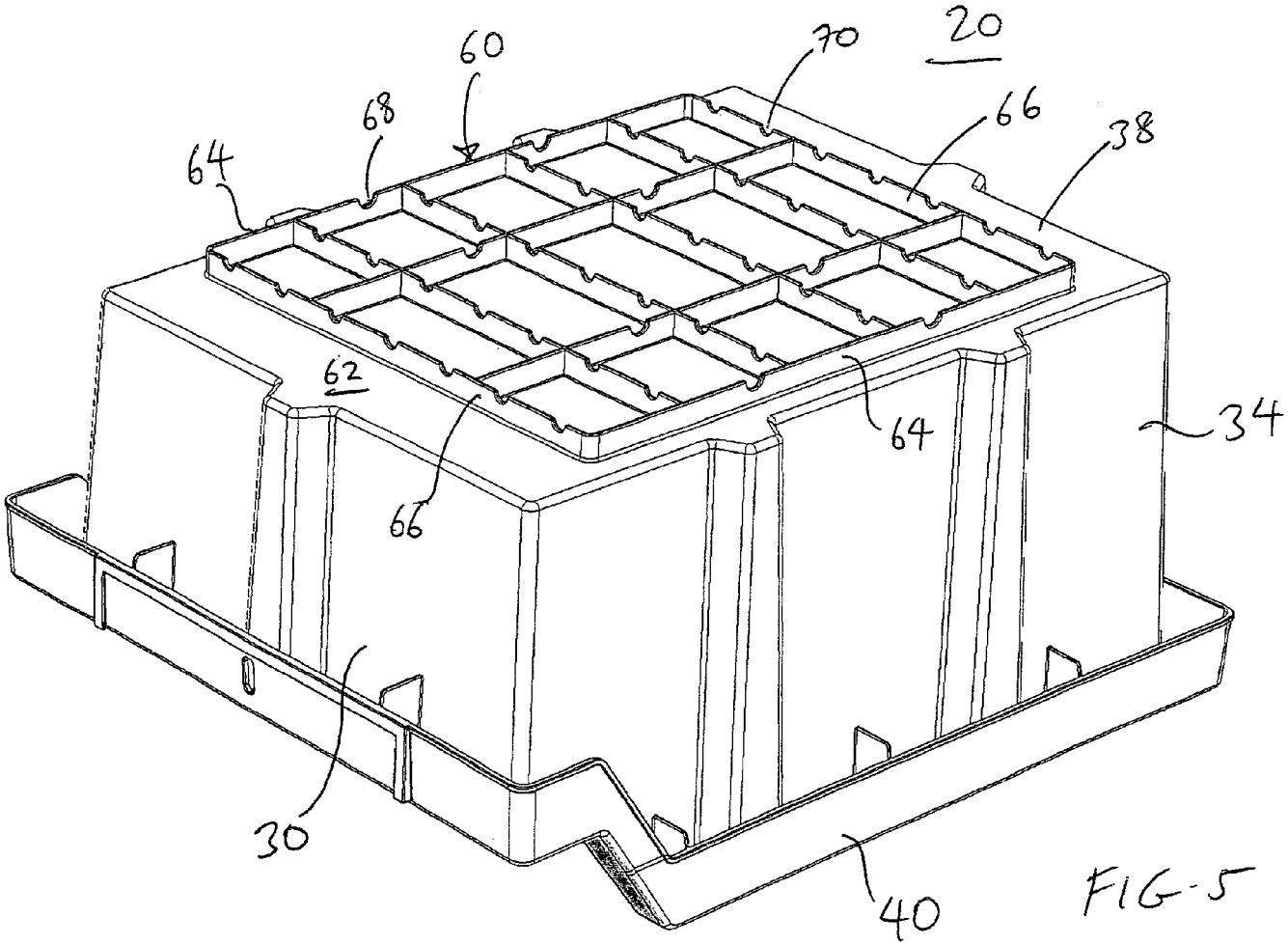
FIG. 5 is a bottom plan view of the storage bin of FIG. 3.
Figure 6:
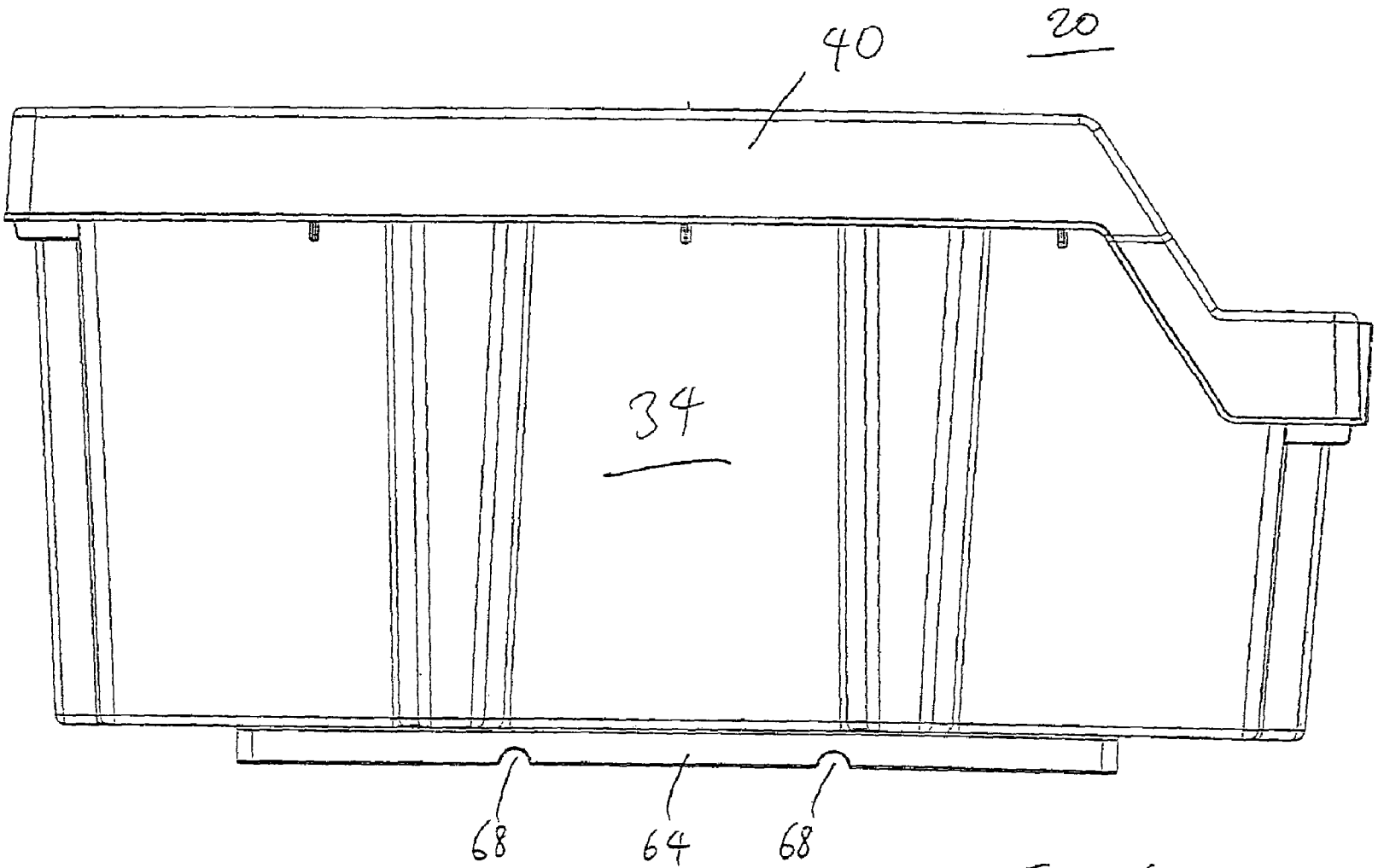
FIG. 6 is a side plan view of the storage bin of FIG. 3.
Figure 7:
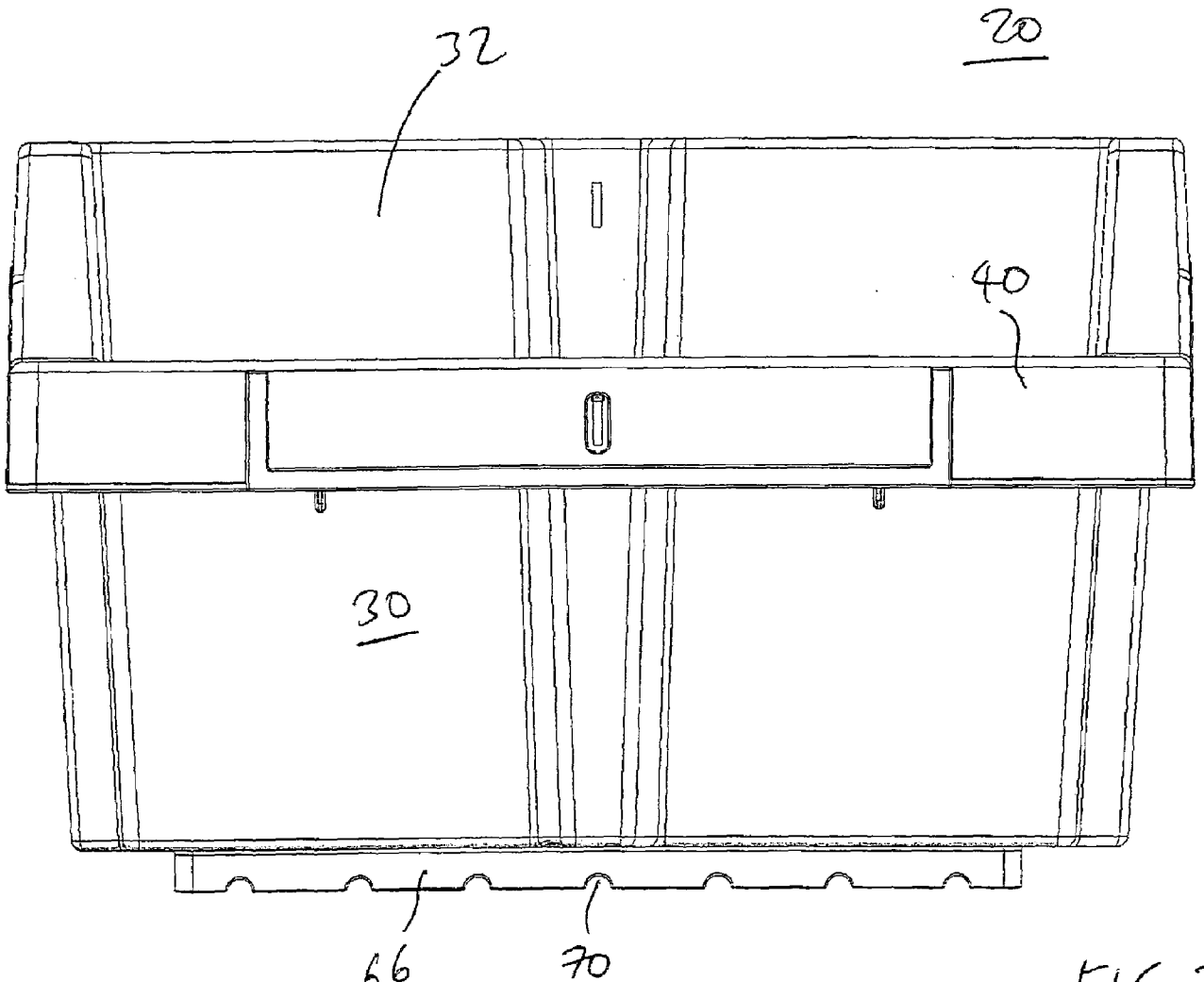
FIG. 7 is a front plan view of the storage bin of FIG. 3.
Figure 8:
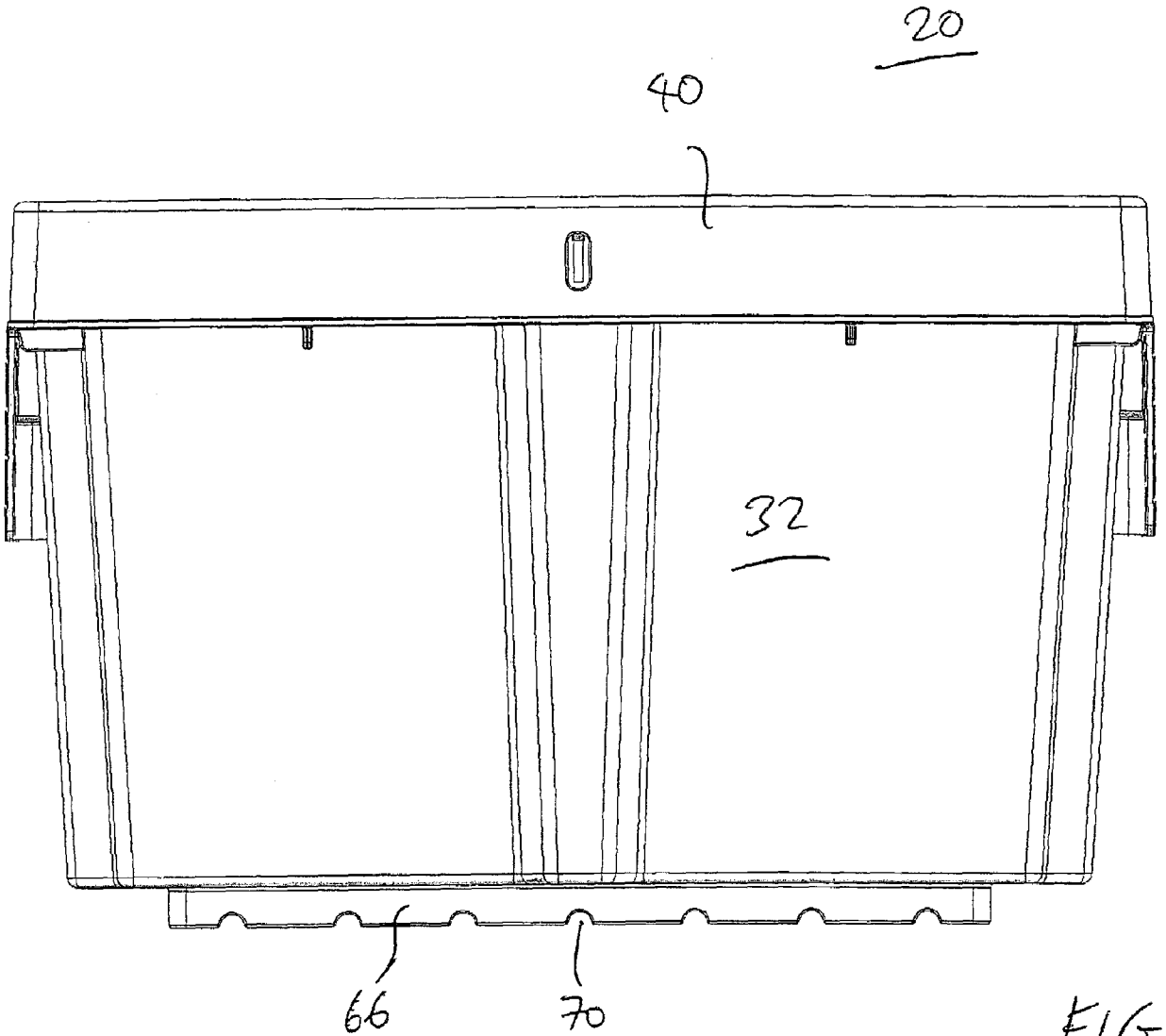
FIG. 8 is a rear plan view of the storage bin of FIG. 3.

Referring to FIGS. 3 and 4, an optional divider 42 can be provided to divide the interior space 58 defined by the walls 30, 32, 34, 36, 38, to provide more organized storage of articles within the bin 20. The divider 42 has a wall portion 44 with transverse extensions 46 provided at the opposing ends of the wall portion 44. In this embodiment, slots 48 and 50 can be provided in the front wall 30 and the rear wall 32, respectively, with each slot 48, 50 adapted to receive one of the transverse extensions 46 of the divider 42.

Figure 9:
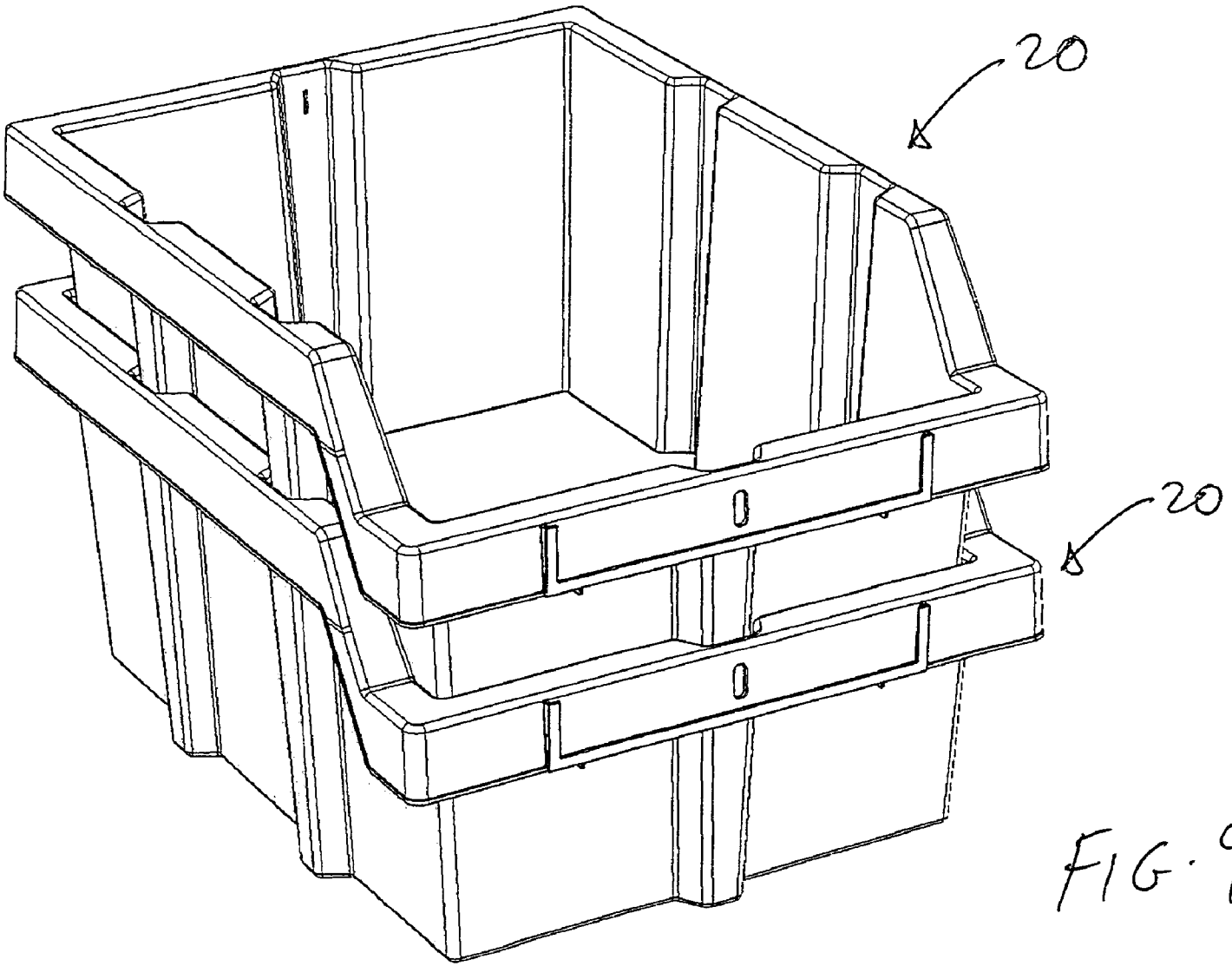
FIG. 9 is an exploded perspective view illustrating the nesting of two of the storage bins of FIG. 3.

As shown in FIG. 9, a plurality of the bins 20 can be nested together by fitting one bin 20 inside the interior space 58 of another bin 20. The walls 30, 32, 34, 36 are slightly angled with the top opening of the bin 20 having a larger surface area than the bottom wall 38. In other words, the bin 20 is smaller at the bottom than at the top, so that a plurality of identical bins 20 can be nested within each other.

Although FIGS. 3-8 illustrate the bin 20 as having a four-sided configuration, this is not necessary since the bin 20 can assume any configuration (e.g., triangular, oval, circular, etc.) as long as the guide system 60 is provided on the bottom surface 62 of the bottom wall 38.

Referring to FIGS. 5-8 and 10-11, a guide system 60 is provided on the bottom surface 62 of the bottom wall 38. The guide system 60 has a plurality of first rails 64 and a plurality of second rails 66 that are arranged to be perpendicular to each other. For example, the first rails 64 are preferably parallel to each other, and generally parallel to the side walls 34 and 36. Similarly, the second rails 66 are preferably parallel to each other, and generally parallel to the front wall 30 and the rear wall 32. Each of these rails 64, 66 are attached to the bottom surface 62. For example, the rails 64, 66 can be formed (e.g., extruded or injected) in one piece together with the bottom wall 38.

A plurality of first grooves 68 are provided in spaced-apart manner along each of the first rails 64. Each of the first grooves 68 is aligned with the corresponding first grooves 68 on the other first rails 64 so that the corresponding first grooves 68 would form a straight row of first grooves 68 across all the first rails 64. Similarly, a plurality of second grooves 70 are provided in spaced-apart manner along each of the second rails 66. Each of the second grooves 70 is aligned with the corresponding second grooves 70 on the other second rails 66 so that the corresponding second grooves 70 would form a straight row of second grooves 70 across all the second rails 66.

Figure 10:
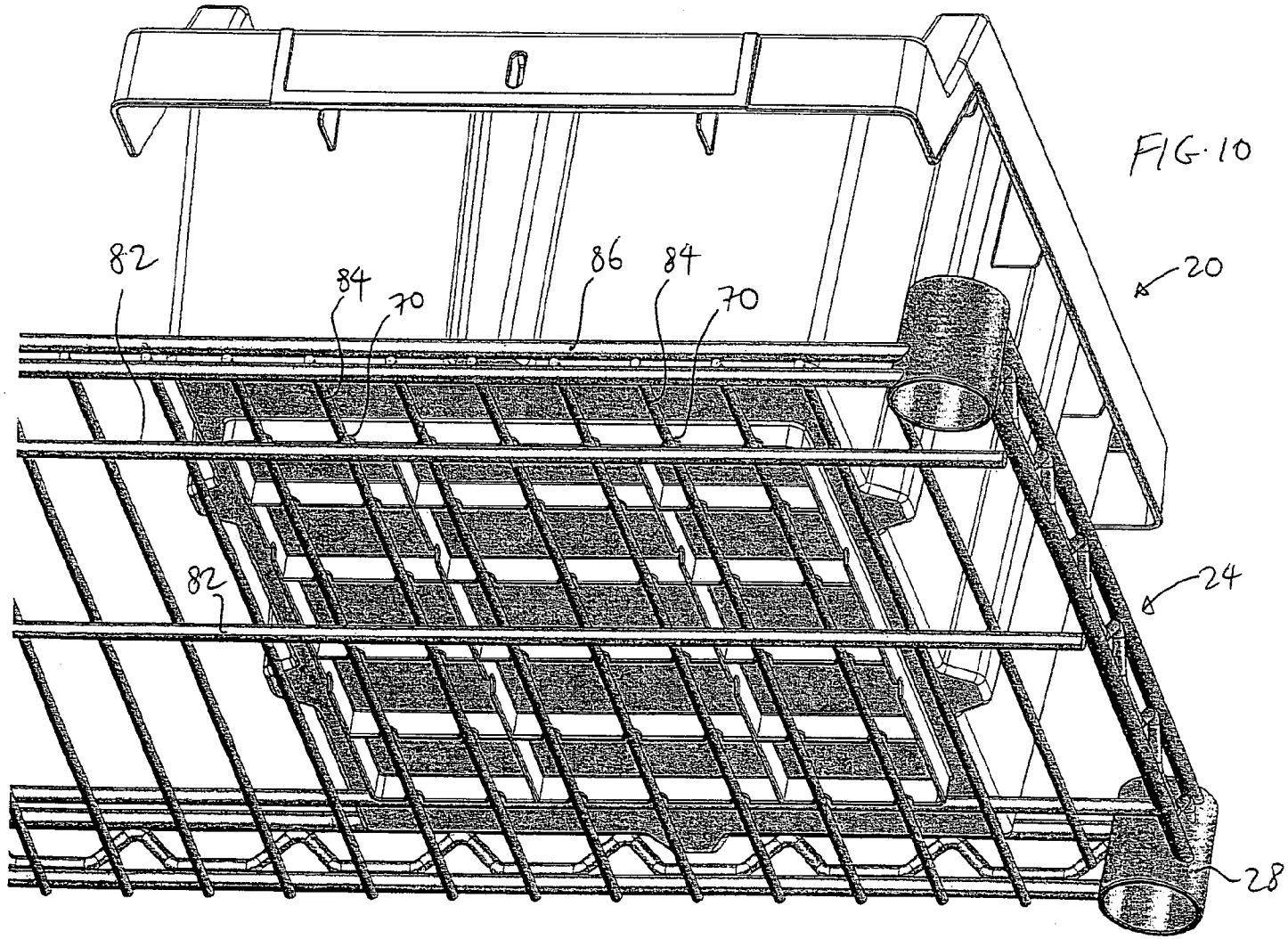
FIG. 10 is a bottom perspective view illustrating how the storage bin of FIG. 3 is retained on a shelf of the system of FIG. 1.
Figure 11:
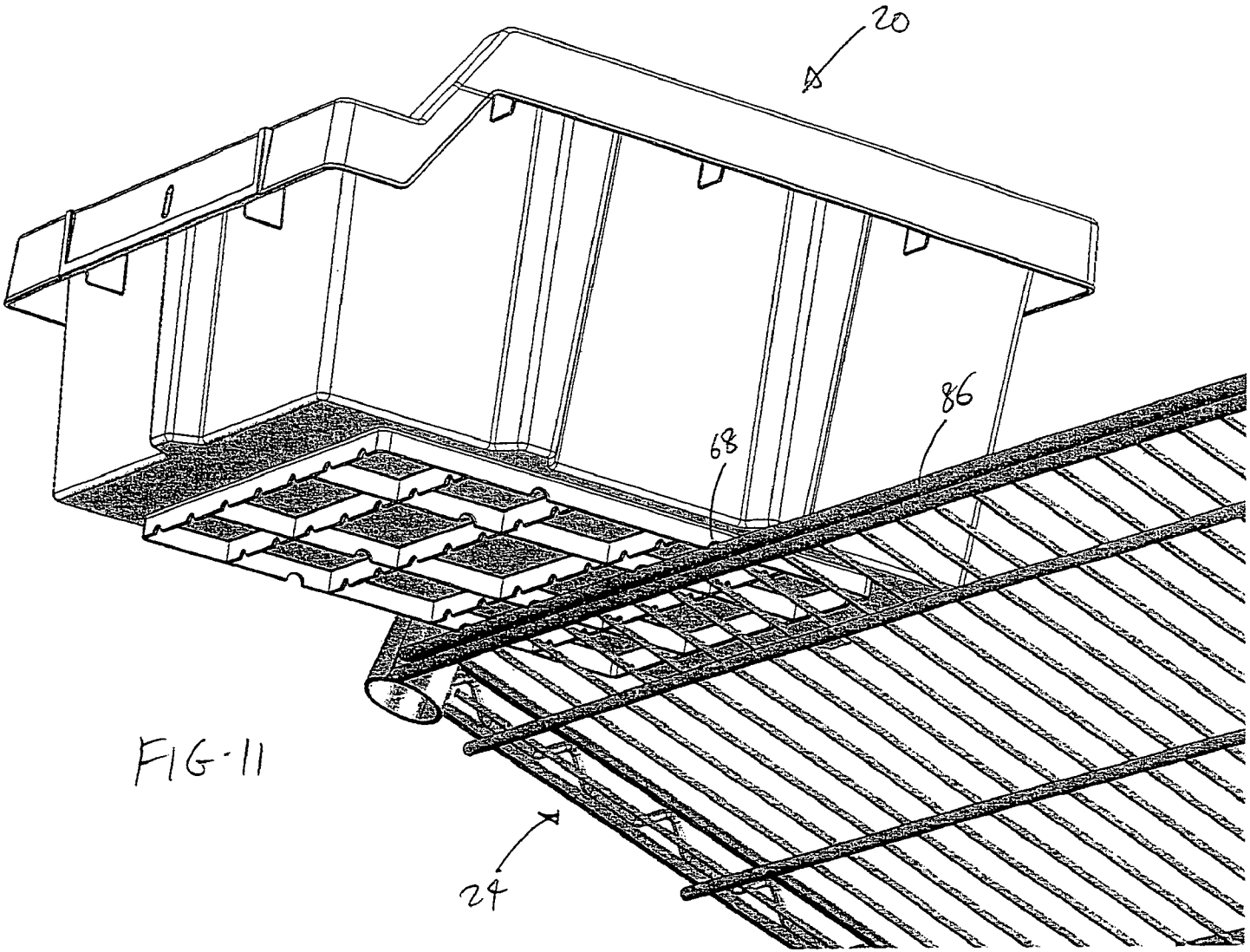
FIG. 11 is a bottom perspective view illustrating how the storage bin of FIG. 3 is pivoted about a shelf of the system of FIG. 1.

As best shown in FIG. 10, the second grooves 70 are adapted to receive a row of parallel wire rods 84 on the shelf 24. Depending on how the wire rods 82 are connected to the wire rods 84, the first grooves 68 can also be adapted to receive the parallel wire rods 84, or a front border rod 86, on the shelf 24. The latter use is illustrated in FIG. 11, where the front border rod 86 of the shelf 24 is shown as being received inside an aligned row of first grooves 68. The grooves 68 and 70 are sized to accommodate the diameter of the wire rods 84 and 86 (and/or 82), respectively, with the intention being to obtain a snug fit of the corresponding wire rod 84 and 86 in the corresponding groove 70 and 68, respectively.

Thus, the guide system 60 provides a plurality of aligned second grooves 70 that are adapted to receive a plurality of parallel wire rods 84 on the shelf 24 so as to prevent the bin 20 from sliding sideways about the shelf 24. The receipt of the wire rods 84 inside the second grooves 70 provides a loose engagement mechanism which allows for easy removal by the user, yet provides effective securement to the shelf 24 because the weight of the objects and articles stored inside the bin 20 will exert sufficient weight to maintain the wire rods 84 securely inside the second grooves 70. This feature is best illustrated in FIG. 10.

In addition, the guide system 60 provides a plurality of aligned first grooves 68 that are adapted to receive the front border rod 86 to allow the bin 20 to be pivoted about the front border rod 86, thereby allowing the user to easily access the contents inside the bin 20 without tipping the bin 20 over. In particular, the bin 20 can be pulled partially out of the shelf 24 (as shown in FIGS. 1 and 2), and then the front border rod 86 can be received in a row of first grooves 68 and pivoted thereabout. The height of the posts 26 can be provided to be slightly higher than the height of the walls 32, 34, 36 of the bin 20, so that the top of the rear wall 32 of the bin 20 will engage the shelf 24 above the bin 20 (see FIG. 2) when the front of the bin 20 is pivoted downward to allow access to the interior space 58, thereby preventing the bin 20 from falling off the shelf 24. Thus, the user can actually slide the bin 20 partially out of the shelf 24 and pivot the bin 20 to access the contents inside the bin 20 without having to worry about the bin 20 falling off the shelf 20. In fact, the user can select different rows of the first grooves 68 to vary the degree to which the bin 20 can be pivoted. For example, if the front border rod 86 is positioned in the row of first grooves 68 nearest the front wall 32, the bin 20 can pivot less than if the front border rod 86 is positioned in the row of first grooves 68 nearest the rear wall 32.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A shelving system, comprising:

a plurality of shelves, each shelf having a plurality of intersecting wire rods;

a plurality of posts connected to the shelves and separating the shelves;

a storage bin, comprising:

a bottom wall having a bottom surface;

at least one side wall;

an interior space enclosed by the at least one side wall and the bottom wall;

a plurality of rails provided on the bottom surface of the bottom wall, with each rail having a groove, and wherein the groove of each of the plurality of rails is aligned to form a row of grooves; and wherein the storage bin is seated on one of the shelves, with one of the wire rods in the one of the shelves positioned in the row of grooves.

2. The system of claim 1, wherein the plurality of rails is a plurality of first rails and the row of grooves a first row of grooves, further including:

a plurality of second rails provided on the bottom surface of the bottom wall, with each of the second rails having a groove;

wherein the groove of each of the plurality of second rails is aligned to form a second row of grooves; and wherein the plurality of second rails is perpendicular to the plurality of first rails.

3. The system of claim 1, wherein each shelf further includes a front border rod that is positioned in the second row of grooves.

4. The system of claim 3, wherein the storage bin pivots about the front border rod.

5. The system of claim 1, wherein each of the plurality of rails has a plurality of grooves.

6. The system of claim 1, wherein the at least one side wall comprises a front wall, a rear wall, and two side walls, with the plurality of rails positioned generally parallel to the front wall.

7. The system of claim 1, further including a divider positioned inside the interior space.

8. The system of claim 7, wherein the at least one side wall comprises a front wall and a rear wall, with the front wall and the rear wall each having a slot, and with the divider having opposite transverse extensions that are seated in respective slots.

* * * * *